United States Patent [19]

Black et al.

[11] 4,256,343

[45] Mar. 17, 1981

[54] MECHANISM FOR ADVANCING CONTINUOUS MINING MACHINE THROUGH MINING CYCLE AND TRAMMING MODES

[75] Inventors: Sigmund Black, Beckley; Joseph V. Lagowski, Mabscott; Jerry C. Whitt, Beckley; Roger D. Plumley, Crab Orchard, all of W. Va.

[73] Assignee: Fairchild Incorporated, Beckley, W. Va.

[21] Appl. No.: 39,744

[22] Filed: May 16, 1979

[51] Int. Cl.[3] ..... E21C 29/02; E21D 23/24

[52] U.S. Cl. ..... 299/31; 299/11; 299/33; 299/49; 405/299

[58] Field of Search ..... 299/11, 18, 31, 33, 299/49; 405/299, 300, 301

[56] References Cited

U.S. PATENT DOCUMENTS

| | | | |
|---|---|---|---|
| 3,026,098 | 3/1962 | Wilcox | 299/49 X |
| 3,169,796 | 2/1965 | Long et al. | 299/31 |
| 3,225,547 | 12/1965 | Hoffmann | 405/300 |
| 3,282,403 | 11/1966 | Todd | 198/139 |
| 3,305,268 | 2/1967 | Todd | 299/18 |
| 3,306,667 | 2/1967 | Todd | 299/57 |
| 3,592,010 | 7/1971 | Gaskell | 405/300 |
| 3,858,940 | 1/1975 | Lagowski | 299/18 |

FOREIGN PATENT DOCUMENTS

| | | | |
|---|---|---|---|
| 1189572 | 4/1970 | United Kingdom | 405/299 |
| 1213019 | 11/1970 | United Kingdom | 405/300 |

*Primary Examiner*—Ernest R. Purser

*Attorney, Agent, or Firm*—Cushman, Darby & Cushman

[57] ABSTRACT

An improved advancing mechanism for a dual auger continuous miner of the type adapted to be advanced by a pair of anchoring jack assemblies, a pair of cables extending from the anchoring jack assemblies to a pair of winch mechanisms on the sides of the frame. The mechanism includes a mounting arm mounted on each side of the frame for movement about a vertical axis, a telescoping structure extending longitudinally between each mounting arm and the associated anchoring jack assembly and hydraulic piston and cylinder units for effecting the pivotal movement of each arm and the telescoping movement of each telescoping structure.

11 Claims, 8 Drawing Figures

MECHANISM FOR ADVANCING CONTINUOUS MINING MACHINE THROUGH MINING CYCLE AND TRAMMING MODES

This invention relates to coal mining and more particularly to improvements in the means for advancing continuous mining machines in a coal seam.

While the principles of the present invention have applicability to continuous mining machines embodying other types of cutters, the invention has been particularly developed for applicability with continuous mining machines of the dual auger type. Machines of this type are commercially manufactured and sold under the trademark Wilcox MARK 20 by the Wilcox Manufacturing Co. of Beckley, W. Va. A similar machine, designated the 100L, is manufactured by Jeffrey Manufacturing Company of Columbus, Ohio. The basic construction and mode of operation of these machines is disclosed in Wilcox U.S. Pat. No. 3,026,098. (See also related U.S. Pat. Nos. 3,282,403; 3,305,268; and 3,306,667.)

Machines of the dual auger type, as the name implies, employ two augers as the means for removing the coal from the seam. The augers are oppositely pitched with respect to each other and are mounted on the frame of the machine in forwardly disposed relation with their axes extending generally horizontally forwardly in horizontally spaced parallel relation. The augers are mounted for power driven rotation in opposite directions and for independent vertical movement, as by a pivotal action about an axis parallel to the axis of rotation. Each auger includes a pair of helical blades having a series of cutting teeth at the forward end thereof and a series of teeth extending outwardly of the periphery thereof in longitudinally spaced relation therealong.

The means provided for advancing the auger cutters into the coal seam is similar to that provided in the old undercutting machines, namely, a power driven winch or drum on each side of the frame and a length of cable wound up on each drum. Continuous mining during advancement is accomplished by providing a conveyor on the frame which serves to move the coal removed from the seam by the auger cutters to the rear end of the frame where it can then be conveyed out of the mine by an appropriate conveyor system mounted therein.

Dual auger continuous mining machines of the construction noted above have been advanced into the coal seam by sequentially performing two separate operations, the first of which is referred to as a sumping operation in which the auger cutters are moved generally longitudinally into the seam at one side of the face. The second operation is to move the cutters transversely across the face after sumping has been accomplished. As previously indicated, these movements are accomplished with the use of the cable and drum assemblies on opposite sides of the frame by anchoring the free ends of the cables at appropriate positions within the mine by conventional jacks or the like extendible into engagement between the mine roof and floor and retractable out of such engagement. Thus each sumping movement as well as each laterial movement required a new cable jack setting. Normal advancement required that the crew include two jack setters operating quite close to the face and, quite often, close to the cutters themselves.

In commonly-assigned U.S. Pat. No. 3,858,940, there is disclosed an improvement in the mechanism for advancing the continuous mining machine in the coal seam which eliminates the aforesaid sumping operation. The improvement embodies the provision of a pair of jack assemblies on opposite sides of the rear end portion of the continuous miner frame which are extendible into engagement between the mine roof and floor and retractable out of engagement therewith. The provision of such jack assemblies provides the operator with the capability of restricting the movement of the frame to a pivotal movement within the mine about an axis substantially coincident with an extended one of the jack assemblies and to thereby effect such pivotal movement with the use of a single cable and drum assembly. By mounting the jack assemblies on opposite sides of the frame, this pivotal movement can be alternately performed about automatically properly spaced axes which provide for advancement in the following manner in a coal seam having a short-wall face extending concavely arcuate from one side wall defining one end thereof to another side wall defining the other end thereof about an axis spaced outwardly thereof. A complete cycle of operation beginning in such a seam with the continuous miner positioned adjacent one end of the arcuate face can be performed in essentially two steps. The first step is to effect a pivotal movement of the continuous miner across the face to a position adjacent the other end thereof about an axis spaced from the axis of the face both in a direction toward the face and in a direction toward the other end thereof to progressively remove a section of coal from the seam which extends inwardly of the face a distance which increases progressively in the direction of movement across the face and to progressively define an advanced face which extends concavely arcuate about the spaced axis of pivotal movement of the continuous miner across the advanced face from the other end to a position adjacent the one end about an axis spaced from the axis of said advanced face both in a direction toward the advanced face and in a direction toward the one end thereof to progressively remove a section of coal from the seam which extends inwardly of the advanced face in a distance which increases progressively in the direction of movement across the advanced face and to progressively define a further advanced face which extends concavely arcuate about the spaced axis of the last-mentioned pivotal movement.

In the arrangement disclosed in the aforesaid patent, the pivotal movements of the machine are effected by providing conventional roof jacks and connecting the winch and cable assemblies therewith. Alternatively, the disclosure provides for mobile power driven vehicular anchor jacks for providing the anchoring point for the cables.

While the pivot jack cycle of movement has received acceptance, there are still many mining conditions where it is preferable to advance the continuous mining machine in the conventional way originally disclosed. The present invention has for its object the provision of an improved means for facilitating the advancement of a continuous mining machine of the type described either in the pivotal mode or the original mode, as well as in a tramming mode. In accordance with the principles of the present invention, this objective is obtained by mounting each of the anchoring jack assemblies on the associated side of the frame for movement with respect to the frame when in a retracted position in a direction to cause the cable means associated therewith to pay out from the associated winch means. In conjunction with this mechanism for mounting each of the mine floor to mine roof anchoring assemblies to the associated side of the frame, there is provided power operated means on the frame for effecting the aforesaid relative movement of each anchoring assembly when retracted with respect to the frame and for permitting movement between the frame and each anchoring assembly when extended under the action of the associated cable and winch assembly. Preferably, each mounting mechanism is in the form of a longitudinally telescoping arm pivoted at one end about a vertical axis to the adjacent side of the mining machine frame and carrying at its free end the associated anchor jack assembly. The power operated means of the mechanism preferably includes a first piston and cylinder unit or hydraulic ram for each telescopic arm for extending and retracting the same and a second piston and cylinder unit or hydraulic ram for effecting the pivotal movement of each arm about the vertically extending axis at the side of the frame. With this preferred arrangement, the pivoting hydraulic rams are utilized basically to position the associated anchoring jack assemblies in a retracted condition with respect to the continuous mining machine frame so that when extended into anchored relation between the mine floor and roof the associated cable and winch means may be actuated to effect the desired movement of the continuous mining machine. By providing hydraulic rams under control of valves having a neutral position, it becomes possible to allow the relative movement effected by the cable and winch arrangements with the associated anchoring jack assemblies in extended position to simply idle during such movement.

Moreover, by extending the anchoring jack assemblies in a direction longitudinally forwardly by virtue of the aforesaid telescopic relationship and utilizing the telescoping hydraulic rams in conjunction with the extension and contraction of the associated anchoring jack assemblies, it becomes possible to greatly facilitate the forward and rearward longitudinal movement of the continuous mining machine as in a tramming mode of operation.

Another object of the present invention is to provide an improved power operated advancing means of the type described which is simple in construction, effective in operation and economical to manufacture and maintain.

These and other objects of the present invention will become more apparent during the course of the following detailed description and appended claims.

The invention may best be understood with reference to the accompanying drawings, wherein an illustrative embodiment is shown.

Figure 1:
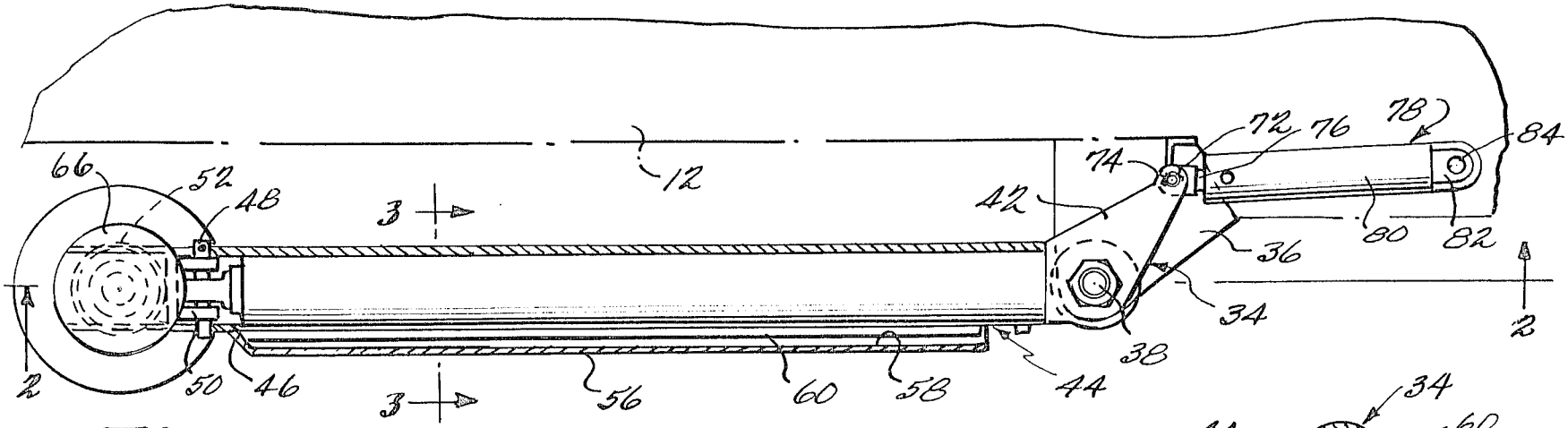
FIG. 1 is a top plan view with certain parts in section for purposes of clearer illustration showing the improvement components of the present invention in solid lines combined with the conventional components of a continuous mining machine shown in dotted lines.

Referring now more particularly to FIG. 1 of the drawings, there is shown therein a continuous mining machine, generally indicated at 10, of the dual auger type to which the improvements of the present invention have been applied. It will be understood that the principles of the present invention have applicability to other types of continuous mining machines, nevertheless particularly advantageous results are achieved in conjunction with known dual auger type continuous machines, which include the Wilcox MARK 20 and the Jeffrey 100L, as aforesaid. Since the present invention involves modification of the known machine it is appropriate to first describe the basic components of the known machine which are retained within the machine 10 of the present invention.

The machine 10 includes a main frame 12 providing a lower surface of generally planar configuration which engages the mine floor so as to support the machine thereon. Disposed forwardly of the frame 12 is a coal cutting and conveying mechanism in the form of two auger cutters 14. The auger cutters 14 are oppositely pitched with respect to each other and are mounted on the frame 12 in forwardly disposed relation with their axes of rotation extending generally horizontally forwardly in horizontally spaced parallel relation. The auger cutters 14 are mounted for power driven rotation about their axes in opposite directions and for independent vertical movement, as by a pivotal action about an axis parallel to the respective axis of rotation. Each auger cutter 14 includes a pair of helical blades having a series of cutting teeth at the forward end thereof and a series of cutting teeth extending outwardly of the periphery thereof in longitudinally spaced relation therealong. It will be understood that the machine 10 includes a suitable source of power such as an electric motor which serves to effect the rotational movement of the augers and that the machine is provided with hydraulic rams or the like for effecting the independent vertical movement of each auger cutter.

The machine 10 is also provided with means for advancing the auger cutters into a coal seam so that the coal engaged by the auger cutters is loosened from the vein and conveyed outwardly of the face. The advancing means, as shown, includes a power driven winch or drum 16 on each side of the frame 12 and a cable 18 wound around each drum 16 so that a free end portion extending from the associated drum and selectively around appropriate forwardly and rearwardly mounted pulleys can be suitably anchored at its extremity, as by anchoring jack assemblies 20. Each anchoring jack assembly 20 is operable to be extendible into engagement between the mine roof and floor and retractable out of such engagement.

The mining machine 10 also includes suitable conveyor means 22 on the main frame 12 for moving the coal removed from the vein by the auger cutters 14 to a position rearwardly of the frame. The coal issuing from the rear end of the conveyor means 22 is preferably handled in a continuous fashion. A bridge conveyor assembly (not shown) may be articulately connected at its forward end to the rearward end of the conveyor means 22, with its rearward end connected to a second conveyor assembly which, in the case of the Wilcox equipment, is referred to as a "Universal Advance Conveyor". This conveyor is, in turn, mounted on an extendible floor conveyor assembly (e.g. the Wilcox Low-Lo Belt Conveyor). The construction and mode of operation of the overall equipment is disclosed in the aforesaid Wilcox U.S. Pat. Nos. 3,026,098; 3,282,403; 3,305,268 and 3,306,667, all of which are hereby incorporated by reference into the present specification.

The present invention also contemplates improvements in the continuous mining machine 10 described above as modified in accordance with the teachings contained in U.S. Pat. No. 3,858,940, the disclosure of which is hereby incorporated by reference into the present application. The teachings contained in this patent importantly include the provision of a pair of extendable and retractable pivot jack assemblies 30 and 32 mounted on the left and right-hand rearward sides of the frame 12 respectively.

The present invention is more particularly concerned with the provision of an improved mechanism, generally indicated at 34, for mounting each of the anchoring jack assemblies 20 on the associated side of the machine frame 12 for movement with respect to the frame in a direction to extend the associated cable while the associated anchoring jack assembly is disposed in a retracted position and for effecting such movement and permitting a relative movement occasioned by the normal operation of the cables when the anchor jack assemblies are in extended relation. To this end, each mechanism 34 includes a fixed mounting plate 36 welded or otherwise rigidly secured to the associated side of the frame. Each mounting plate serves to carry a vertically extending pivot pin or shaft 38. Pivotally mounted to each shaft 38, as by a spherical bearing 40 or the like, is a mounting arm 42. Each spherical bearing 40 provides for the mounting of the associated arm 42 for movement about the vertical axis of the pin or shaft 38 and in addition for a relatively limited amount of movement about a generally horizontal axis so that the arm can swing slightly in a vertical plane as well as move rotationally in a horizontal plane.

Figure 3:
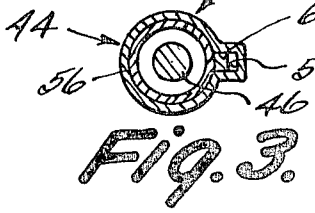
FIG. 3 is an enlarged fragmentary sectional view taken along the line 3—3 of FIG. 1.
Figure 2:
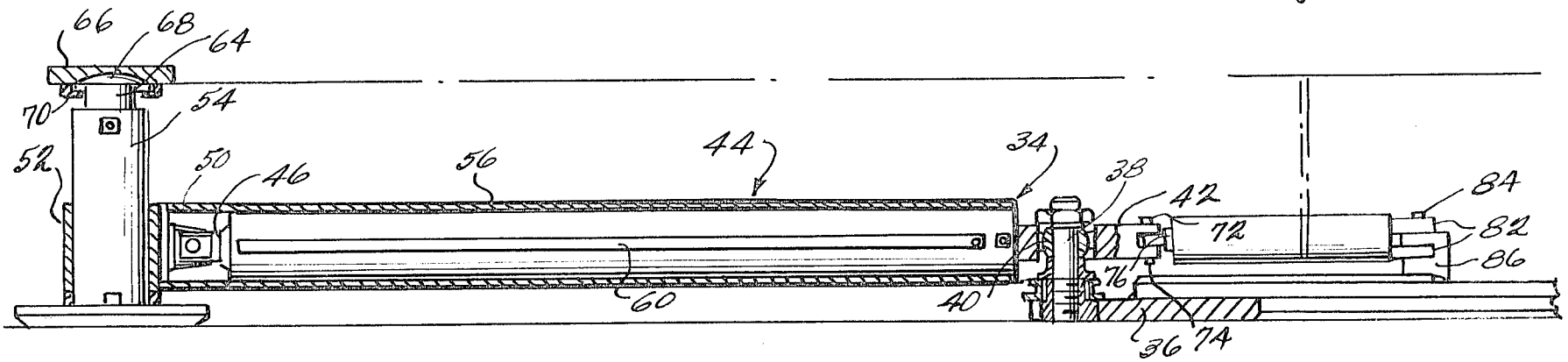
FIG. 2 is an enlarged fragmentary sectional view taken along the lne 2—2 of FIG. 1.

One end of each arm 42 is rigidly secured to one end of the cylinder of a hydraulic piston and cylinder unit 44, the opposite end of which has a piston rod 46 extending therefrom. The outer end of each piston rod 46 is connected, as by a pin 48, to a lug 50 extending outwardly from a sleeve 52 mounted in surrounding relation to a cylinder 54 of the associated anchoring jack assembly 20. Each hydraulic piston and cylinder unit 44 preferably is of the double acting type. The components of each piston and cylinder unit form a part of the mounting means of the mechanism 34 as well as a part of the power operated means for effecting the movement provided by the mechanism 34. Also included as a preferable part of each mechanism 34 is a sleeve 56 which is fixed at one end to the lug and sleeve structure 50 and 52 and extends over the exterior periphery of the cylinder of the unit 44 in telescopic relation thereto. As best shown in FIG. 3, the sleeve 56 is formed with a longitudinaly extending offset portion defining a longitudinally extending groove 58 opening to the interior periphery of the sleeve within which is slidably mounted a longitudinally extending key or rib 60 fixed to the exterior periphery of the cylinder of the unit 44.

It will be noted that the lower end of the cylinder 54 of each anchoring jack assembly 20 is provided with a generally saucer-shaped base 62 which facilitates movement of the assembly along the mine floor. The upper end of the piston rod 64 of each anchoring jack assembly has a roof engaging structure or plate 66 articulately mounted thereon as by a segmentally shaped cap 68 on the upper end of the piston rod 64 seated within a correspondingly shaped recess in the lower surface of the roof engaging plate 66. A flanged annular member 70 serves to retain the roof engaging element on the segmentally shaped cap of the piston rod while permitting the aforesaid articulated movement.

When each piston and cylinder unit 44 is disposed in a longitudinally forwardly extending position alongside the associated side of the frame 12 of the continuous mining machine 10, the associated mounting arm 42 includes a portion which extends laterally inwardly and rearwardly and terminates in a clevis or bifurcated lug structure, indicated at 72. Each bifurcated lug structure 72 is pivotally interconnected, as by a pivot pin 74, to the outer end of a piston rod 76 forming a part of a second piston and cylinder unit 78 which likewise is preferably of a double acting hydraulic type. Each unit 78 includes a cylinder 80 having a pair of mounting lugs 82 extending from the end thereof opposite from the piston rod end. Each pair of lugs 82 is pivotally connected to the associated side of the frame 12 by a pivot pin 84 extending through a suitable mounting bracket 86 rigidly secured to the side of the frame, as by welding or the like.

Figure 4:
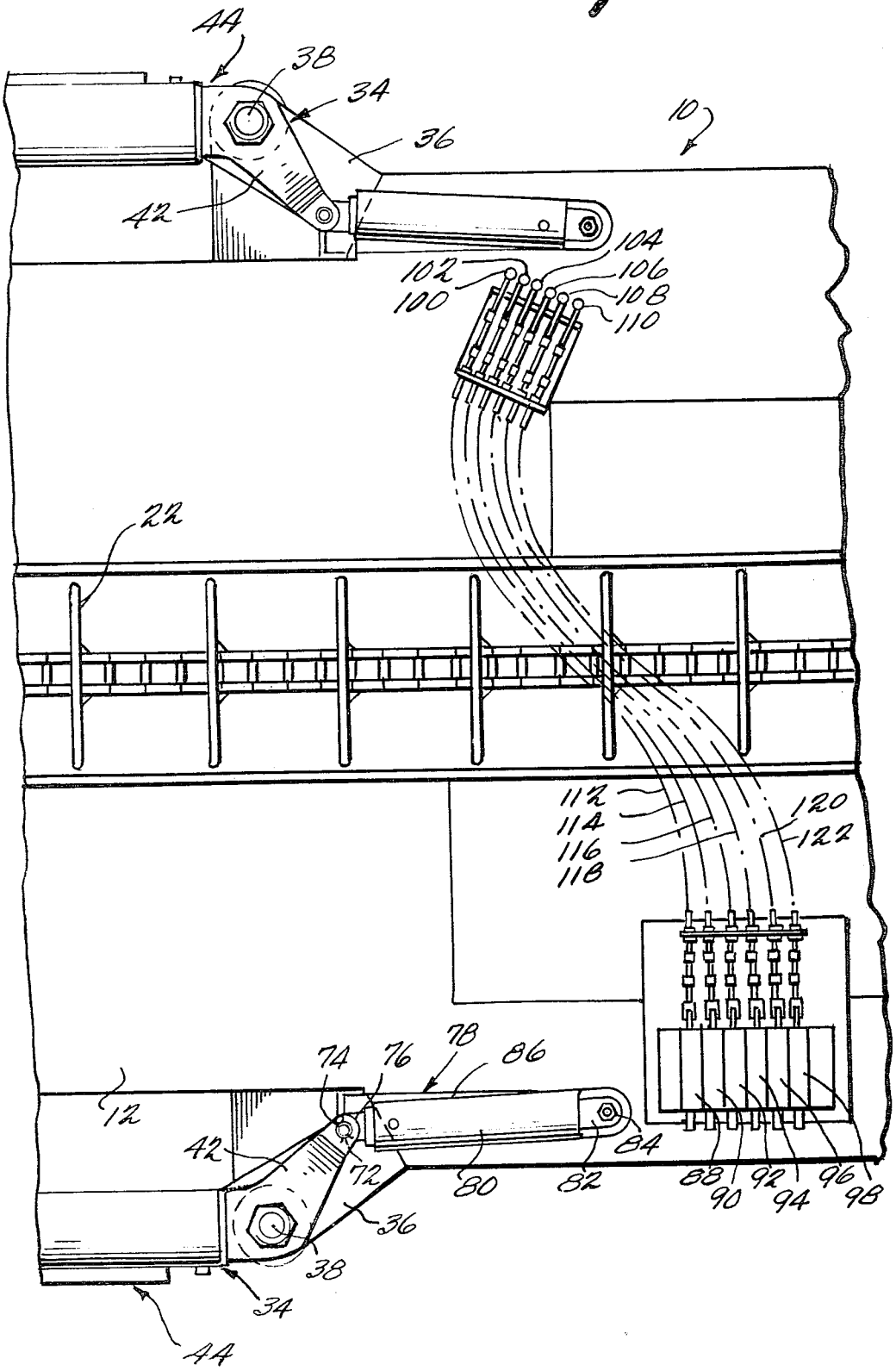
FIG. 4 is a fragmentary top plan view of the central portion of the continuous mining machine showing the control assembly for the improved advancing mechanism of the present invention.

In accordance with the principles of the present invention, means is provided for controlling the operation of the piston and cylinder unit embodied in each anchor jack assembly, each associated main telescoping piston and cylinder unit 78. A preferred arrangement is shown in FIG. 4. As shown, such means may include a bank of six valves indicated by the reference numerals 88, 90, 92, 94, 96 and 98. Each of the valves 90, 92, 96 and 98 is of conventional construction and is of the type which includes a central null position in which both ends of the cylinder are communicated with sump oil. This null position enables the piston and cylinder units 44 and 78 controlled thereby to be moved in either direction. In addition to the null or idler position provided by each valve 90, 92, 96 and 98, each of these valves also includes two operative positions, one in which sump oil is connected to one side of the piston of the associated unit 44 or 78, while pump oil is connected to the other side thereof and a second position in while sump oil is connected to the opposite side of the piston of the associated unit 44 or 78 while pump oil is connected to the other.

In FIG. 4 there is illustrated a plurality of valve actuators 100, 102, 104, 106, 108 and 110 retained in a remote assembly and interconnected with the valves by a corresponding series of Bowden wires 112, 114, 116, 118, 120 and 122. It will be understood that the valve actuator control assembly, when brought into proximity to the operator, can be actuated by the operator to move any one or combination of valves 88, 90, 92, 94, 96 and 98 into any other of the three positions into which each valve can be moved.

In the arrangement shown, actuator 100 is connected through the Bowden wire assembly 112 to actuate valve 88 which, in turn, serves to control the movement of hydraulic fluid to and from the left-hand piston and cylinder unit of the left-hand anchor jack assembly 20. Actuator 102 serves through Bowden wire 114 to actuate valve 90 which controls the movement of hydraulic fluid to and from the left-hand main telescoping piston and cylinder unit 44. Actuator 104 is connected through Bowden wire 116 to actuate valve 92 which serves to control the flow of hydraulic fluid to and from the left-hand pivoting piston and cylinder unit 78. Similarly,the actuator 106 operates through Bowden wire 118 to actuate the valve 94 which controls the movement of hydraulic fluid to and from the right-hand piston and cylinder unit of the right-hand anchor jack assembly 20. Actuator 102 serves through Bowden wire 120 to move valve 96 controlling the flow of hydraulic fluid to and from the right-hand main telescoping piston and cylinder unit 44. Finally, actuator 110, through Bowden wire 122 functions to move valve 98 controlling the right-hand pivoting piston and cylinder unit 78.

Figure 6:
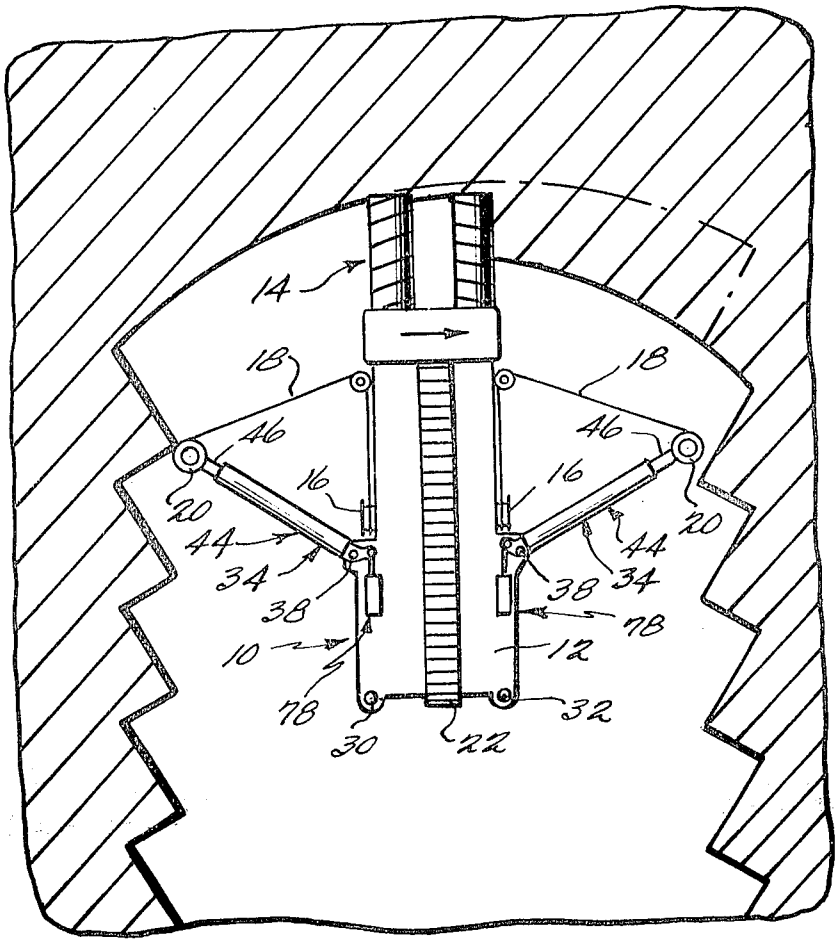
FIGS. 5, 6 and 7 are schematic top plan views illustrating sequences in one cycle of operation utilizing the improvements of the present invention.
Figure 5:
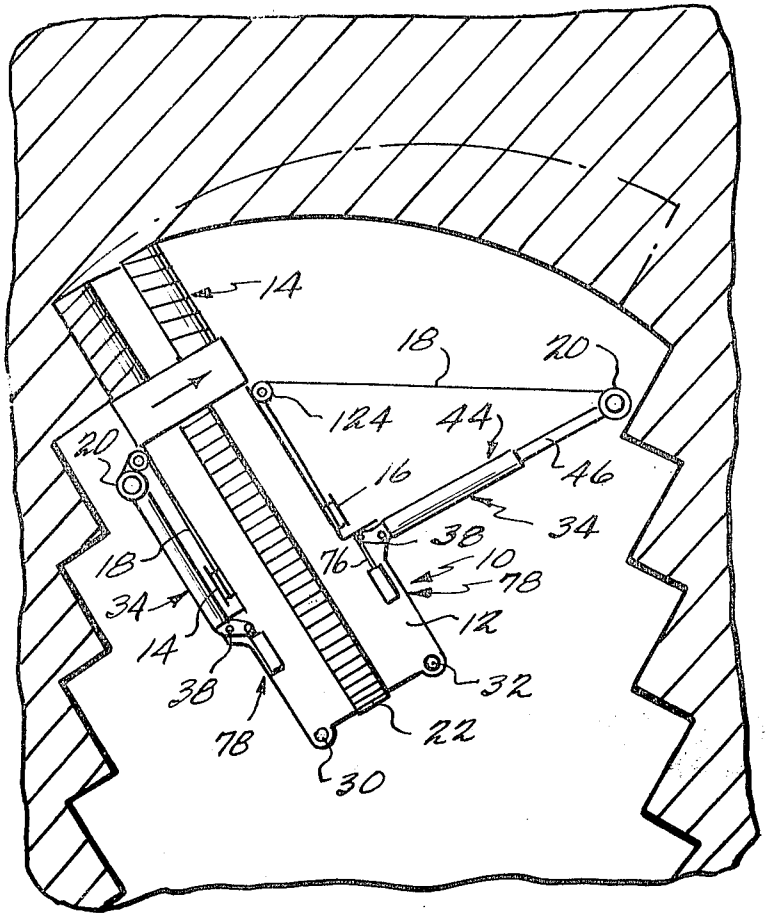
Figure 7:
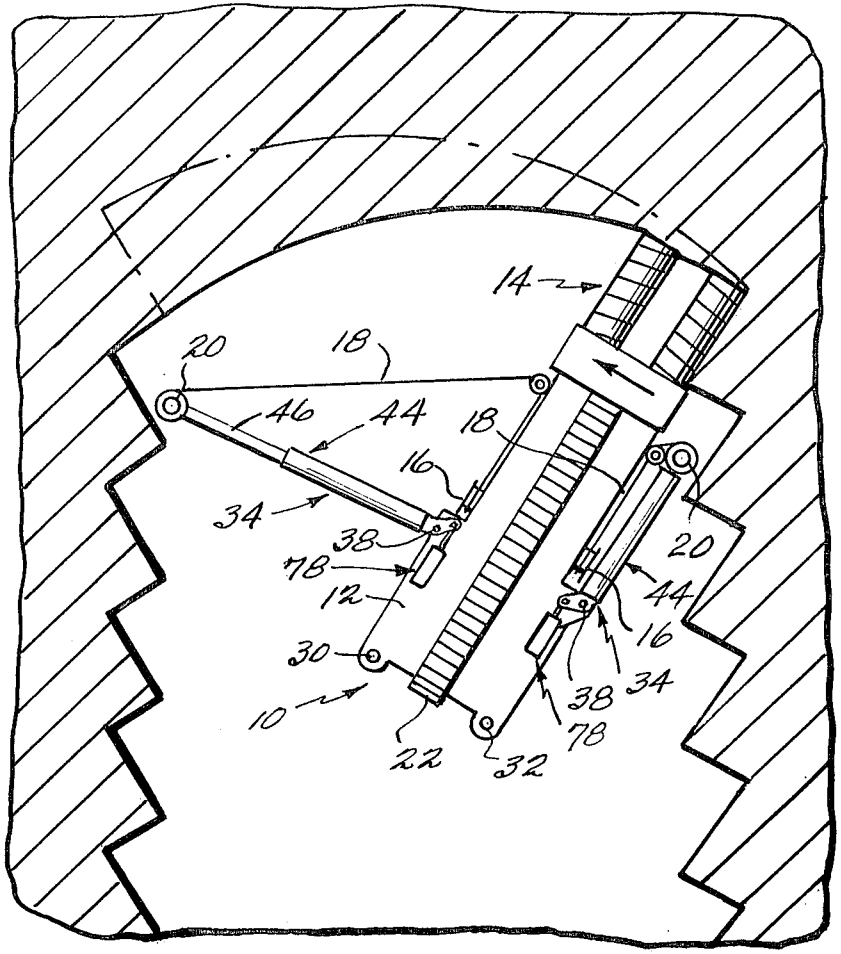

FIGS. 5, 6 and 7 illustrate one cycle of operation utilizing the improvements of the present invention when proceding through an operative mining cycle in accordance with the teachings contained in U.S. Pat. No. 3,858,940. FIG. 5 illustrates a convenient starting point for the cycle in which the auger cutters 14 are disposed adjacent the left-hand side wall of the face. Prior to commencing the operation of the cycle, right-hand pivot jack assembly 32 is extended so as to engage the mine roof and provide a fixed axis of pivotal movement for the machine 10 within the seam. The left-hand pivot jack is, of course, moved into a retracted position and the piston and cylinder unit of the right-hand anchoring jack assembly 20 is moved into a position adjacent the right-hand side wall of the mine seam by appropriate actuation of the control actuators 108 and 110 so that the valves 96 and 98 respectively will cause the associated piston and cylinder units 44 and 78 to extend. When the associated right-hand anchoring jack assembly has been moved adjacent the right side wall of the seam into the position shown in FIG. 5, control actuator 106 is actuated to move valve 94 into a position to extend the piston and cylinder unit of the right-hand anchoring jack assembly 20. Valve 94, as well as valve 88 controlling the piston and cylinder unit of the anchoring jack assemblies 20, may be the type which prevent flow of fluid into and out of either side of the cylinder when in a null position, contrary to the free idling type of null position provided by valves 90, 92, 96 and 98. Where locking type valves are used for the anchor jack assembly piston and cylinder units, the appropriate control actuator 106 is then moved into a null position and so are the actuators 108 and 110 for the valves 96 and 98. Once the right-hand pivot jack 32 has been extended and the right-hand anchor jack assembly has been extended in the position shown in FIG. 5, the first procedural step of the pivot cycle can be accomplished simply by actuating the electric motor for the right-hand winch which serves to wind up the cable around the right-hand winch with the cable being trained about a forward pulley 124. As the cable is wrapped around the winch the entire machine will pivot in a clockwise direction as viewed in FIG. 5 about the extended right-hand pivot tack assembly 32.

FIG. 6 shows the machine moved half way through its pivotal movement and FIG. 7 illustrates the position of the parts after the pivotal movement to the right has been completed. The manner in which the left-hand mechanism 34 is handled during the aforesaid right-hand pivotal movement can vary. In general, it can be stated that it is preferable to initially extend the anchoring jack assembly 20 and allow the associated left-hand valves 90 and 92 to remain in their idler position and insure that the cable associated with the left-hand winch can freely pay out. In this way, when the machine finishes the right-hand pivotal movement, the left-hand anchoring jack assembly will be positioned in proximity to the position into which it is to be moved prior to commencing the left-hand pivotal movement constituting the second step in the operating cycle. This position is clearly shown in FIG. 7 and here again it will be understood that the left-hand pivotal movement is accomplished by extending the left-hand pivot jack assembly 30 while retracting the right-hand pivot jack assembly 32 and actuating the left-hand winch while maintaining the valves 90, 92, 96 and 98 in their idler positions. It can thus be seen that the mechanisms 34 of the present invention enable the operator to achieve a pivot cycle of movement of the type disclosed in U.S. Pat. No. 3,858,940 in a very simple manner, all movements of which are under the control of an operator working the main controls of the mining machine in conjunction with the actuators of the remote control unit for the mechanisms 34.

It will also be understood that by suitably positioning both of the anchor jack assemblies 20 and extending both of the same into anchored relation between the mine roof and floor, the mining machine 10 can be moved through a conventional cycle without the utilization of the pivot jack assemblies 30 and 32 which are maintained in a retracted position. In this regard, it will be noted that a basic distinction between pivot operation utilizing the pivot jacks 30 and 32 in comparison with conventional operation is that in conventional operation it becomes necessary to use both cables and anchoring jack assemblies 20 to effect movement, whereas in the pivot mode only one is required to be used.

It will further be understood that the mechanisms 34 provide a means for effecting controlled movement of the mining machine 10 which can be utilized in lieu of the cables and winches. In operations of this type, the movements are preferably effected through the operation of the main telescoping piston and cylinder units 44, the pivoting units 78 being used almost exclusively for the positioning of the anchor jack assemblies 20 while in retracted position relative to the miner frame 12 preferably in a direction outwardly of the associated side of the frame.

Figure 8:
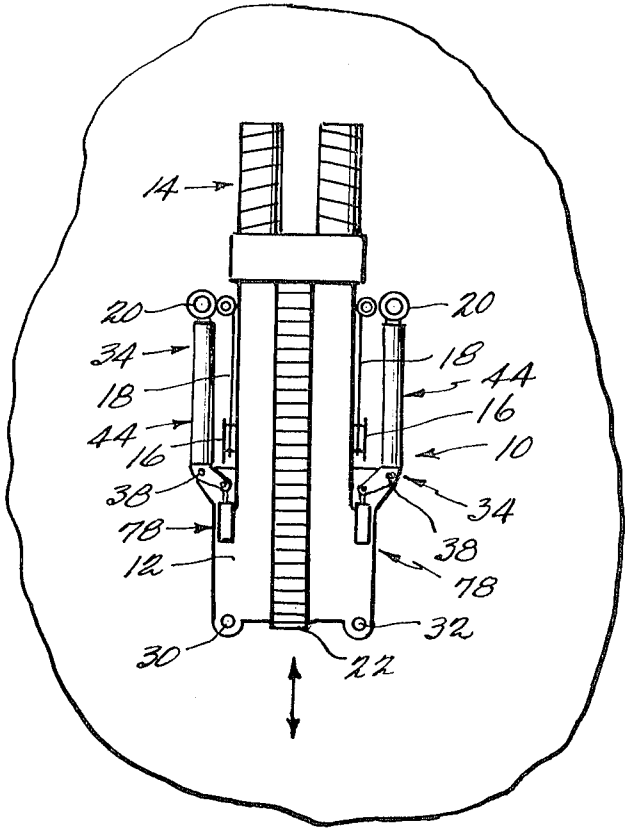
FIG. 8 is a view similar to FIGS. 5, 6 and 7 illustrating the improvements of the present invention in a tramming mode.

The arrangement is particularly suitable as a means for tramming the continuous mining machine within the mine to move it from one position of operation to another. FIG. 8 illustrates a preferred position of the mechanisms 34 under the tramming mode of operation and it will be noted that in general the pivoting units 78 are fully retracted and the main telescoping units 44 extend generally parallel to one another and in a longitudinal direction. With the parts in the position shown in FIG. 8, the machine can be moved in a longitudinally rearward direction by extending the anchoring jack assemblies 20, retracting the pivot jack assemblies 30 and 32 and then extending the main telescoping piston and cylinder units 44. At the end of the stroke of the units 44, the pivot jacks 30 and 32 may be extended if there is any tendency for the machine 10 to move, the anchoring jack assemblies 20 are retracted and then the main telescoping units 44 are retracted into the position shown in FIG. 8. Forward longitudinal movement is achieved by reversing the above procedure.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. A continuous mining machine for removing coal from a coal seam having a shortwall face extending from a side wall defining one end thereof to another side wall defining the other end thereof, said machine comprising:

an elongated frame, power driven cutting and conveying means carried by said frame in forwardly disposed relation thereto and operable during relative movement of said frame with respect to said face to cut a room section in the coal seam inwardly of the face thereof while continuously conveying the cut coal outwardly of the face, conveyor means operatively associated with said frame for continuously moving the coal rearwardly away from the mine face which is cut and conveyed outwardly of the mine face during the formation of said room section by said cutting and conveying means, and means for moving said frame and said cutting and conveying means forwardly and transversely to effect the formation of said room section, said means including a power operated winch means on each side of said frame, a vertically extendable and retractable mine floor to mine roof anchoring jack assembly on each side of said frame, and cable means extending from each winch to the associated anchoring assembly for effecting movement of said frame and said cutting and conveying means when an anchoring assembly is extended into anchored relation between the mine floor and mine roof and the associated cable means is wound up on the associated winch means, the improvement which comprises:

means mounting each of said anchoring jack assemblies on the associate side of said frame for movement with respect to said frame when in a retracted position in a direction to cause the cable means associated therewith to pay out from the associated winch means, and power operated means carried by said frame for effecting the aforesaid relative movement of each anchoring jack assembly when retracted with respect to said frame and for permitting the aforesaid movement between said frame and each anchoring jack assembly when extended under the action of said cable means and said winch means.

2. The improvement as defined in claim 1 wherein said mounting means for each anchoring jack assembly comprises a mounting arm, means mounting said mounting arm on the associated side of said frame for pivotal movement about a generally vertically extending axis and a longitudinally telescoping structure extending longitudinally from said mounting arm to the associated anchoring jack assembly.

3. The improvement as defined in claim 2 wherein each of said telescoping structures includes a piston and cylinder unit.

4. The improvement as defined in claim 3 wherein the cylinder of each piston and cylinder unit includes an elongated rib mounted on the exterior periphery thereof in longitudinally extending relation, each of said telescoping structures further including an outer tubular member connected at one end to the associated anchoring jack assembly and extending telescopically over the associated cylinder, each of said outer tubular members having a longitudinally extending groove in the interior periphery thereof slidably receiving the rib of the associated cylinder.

5. The improvement as defined in claim 2, 3 or 4 wherein said power operated means includes a hydraulic piston and cylinder unit between each mounting arm and the associated side of said frame.

6. A continuous mining machine for removing coal from a coal seam having a shortwall face extending from a side wall defining one end thereof to another side wall defining the other end thereof, said machine comprising:

an elongated frame, power driven cutting and conveying means carried by said frame in forwardly disposed relation thereto and operable during relative movement of said frame with respect to said face to cut a room section in the coal seam inwardly of the face thereof while continuously conveying the cut coal outwardly of the face, conveyor means operatively associated with said frame for continuously moving the coal rearwardly away from the mine face which is cut and conveyed outwardly of the mine face during the formation of said room section by said cutting and conveying means, and means for moving said frame and said cutting and conveying means forwardly and transversely to effect the formation of said room section, said means including a power operated winch means on each side of said frame, a vertically extendable and retractable mine floor to mine roof anchoring jack assembly on each side of said frame, cable means extending from each winch to the associated anchoring assembly for effecting movement of said frame and said cutting and conveying means when an anchoring assembly is extended into anchored relation between the mine floor and mine roof and the associated cable means is wound up on the associated winch means, and a vertically extendable and retractable mine floor to mine roof pivot jack assembly in each side of said frame at the rearward end thereof, the improvement which comprises:

means mounting each of said anchoring jack assemblies on the associate side of said frame for movement with respect to said frame when in a retracted position in a direction to cause the cable means associated therewith to pay out from the associated winch means, and power operated means carried by said frame for effecting the aforesaid relative movement of each anchoring jack assembly when retracted with respect to said frame and for permitting the aforesaid movement between said frame and each anchoring jack assembly when extended under the action of said cable means and said winch means.

7. The improvement as defined in claim 6 wherein said mounting means for each anchoring jack assembly comprises a mounting arm, means mounting said mounting arm on the associated side of said frame for pivotal movement about a generally vertically extending axis and a longitudinally telescoping structure extending longitudinally from said mounting arm to the associated anchoring jack assembly.

8. The improvement as defined in claim 7 wherein each of said telescoping structures includes a position and cylinder unit.

9. The improvement as defined in claim 8 wherein the cylinder of each piston and cylinder unit includes an elongated rib mounted on the exterior periphery thereof in longitudinally extending relation, each of said telescoping structures further including an outer tubular member connected at one end to the associated anchoring jack assembly and extending telescopically over the associated cylinder, each of said outer tubular members having a longitudinally extending groove in the interior periphery thereof slidably receiving the rib of the associated cylinder.

10. The improvement as defined in claim 7, 8 or 9, wherein said power operated means includes a hydraulic piston and cylinder unit between each mounting arm and the associated side of said frame.

11. A continuous mining machine for removing coal from a coal seam having a shortwall face extending from a side wall defining one end thereof to another side wall defining the other end thereof, said machine comprising:

an elongated frame, power driven cutting and conveying means carried by said frame in forwardly disposed relation thereto and operable during relative movement of said frame with respect to said face to cut a room section in the coal seam inwardly of the face thereof while continuously conveying the cut coal outwardly of the face, conveyor means operatively associated with said frame for continuously moving the coal rearwardly away from the mine face which is cut and conveyed outwardly of the mine face during the formation of said room section by said cutting and conveying means, and means for moving said frame and said cutting and conveying means forwardly and transversely to effect the formation of said room section, said means including an arm mounted on each side of said frame for pivotal movement about a generally vertically extending axis, a longitudinally telescoping structure carried by each arm and extending longitudinally therefrom and a vertically extendable and retractable mine floor to mine roof anchoring jack assembly mounted on the outer end portion of said telescoping structure and power operated means for pivoting each of said arms about its vertical axis and power operated means for effecting a longitudinal telescoping movement of each of said telescoping structures.

* * * * *